US005392866A

United States Patent [19]

White

[11] Patent Number: 5,392,866

[45] Date of Patent: Feb. 28, 1995

[54] TRACTOR STEEL POST DRIVER

[76] Inventor: Monte W. White, 9558 Rd. E., Wiggins, Colo. 80654

[21] Appl. No.: 254,555

[22] Filed: Jun. 6, 1994

[51] Int. Cl.[6] ..... B25D 9/00

[52] U.S. Cl. ..... 173/90; 173/132; 254/29 R

[58] Field of Search ..... 173/90, 184, 129, 132; 254/29 R

[56] References Cited

U.S. PATENT DOCUMENTS

| | | | |
|---|---|---|---|
| 839,246 | 12/1906 | Williams | 173/90 |
| 3,129,924 | 4/1964 | Froh | 254/29 R |
| 3,823,785 | 7/1974 | Toliver | 173/90 |
| 4,241,795 | 12/1980 | Landry, Jr. | 173/132 |
| 4,258,905 | 3/1981 | Brabander | 254/29 R |
| 5,042,591 | 8/1991 | Hull | 173/90 |

*Primary Examiner*—Scott A. Smith

[57] ABSTRACT

A tractor steel post driver comprising an elongated driving assembly having an upper cylindrical pipe and a lower pipe, a bracket formed of two small parallel plates, each of the plates having a free end, each of plates having an aperture therethrough with a pin positioned through the aperture of the plates and apertures at the upper end of the upper pipe with the pipe located between the plates; a pair of collar bolts positioned with their head ends interior of the lower pipes and extending radially outward through lower apertures in the lower pipe; and a collar having a cylindrical upper extent with downwardly extending recesses formed therein adapted to receive the ends of the collar bolts exterior of the tube but interiorly of the nuts with a circular plate at its lower extent having an enlarged diameter to function as a stop when used in driving posts, the collar and plate having an axial aperture for receiving the upper end of a post to be driven by inserting its upper end through the plate and lower half of the collar to the point where contact is made between the upper end of the post and the lower end of the lower pipe.

4 Claims, 4 Drawing Sheets

TRACTOR STEEL POST DRIVER

BACKGROUND OF THE INVENTION

1. Field of the Invention

The present invention relates to a tractor steel post driver and more particularly pertains to driving or setting steel posts into the ground in a faster more convenient manner.

2. Description of the Prior Art

The use of various devices for driving posts into the ground is known in the prior art. More specifically, various devices for driving posts into the ground heretofore devised and utilized for the purpose of driving steel posts into the ground through a wide variety of devices and techniques are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 5,167,288 to McNeil et al. a rod driving tool.

U.S. Pat. No. 4,519,584 to McCray discloses a fence post driver.

U.S. Pat. No. 4,542,880 to Bishop discloses a post driver for tractor with power lift.

U.S. Pat. No. 4,258,905 to Brabander discloses a post-stake driver.

U.S. Pat. No. 3,129,924 to Froh discloses a post press and puller.

In this respect, the tractor steel post driver according to the present invention substantially departs from the conventional concepts and designs of the prior art, and in doing so provides an apparatus primarily developed for the purpose of driving or setting steel posts into the ground in a faster more convenient manner.

Therefore, it can be appreciated that there exists a continuing need for a new and improved tractor steel post driver which can be used for driving or setting steel posts into the ground in a faster more convenient manner. In this regard, the present invention substantially fulfills this need.

SUMMARY OF THE INVENTION

In view of the foregoing disadvantages inherent in the known types of various devices for driving posts into the ground now present in the prior art, the present invention provides an improved tractor steel post driver. As such, the general purpose of the present invention, which will be described subsequently in greater detail, is to provide a new and improved tractor steel post driver and method which has all the advantages of the prior art and none of the disadvantages.

To attain this, the present invention essentially comprises a new and improved tractor steel post driver comprising, in combination, an elongated driving assembly having an upper cylindrical pipe with an upper end and a lower end, and a lower pipe with an upper end and a lower end, the upper pipe and lower pipe being coupled to have a common central axis, the upper end of the lower pipe being enlarged with the lower end of the upper pipe fitted within the enlargement, the upper end of the upper pipe being provided with a radial aperture extending therethrough, the lower end of the lower pipe being provided with a lower radial aperture extending therethrough; a bracket formed of two small parallel plates, each of the plates having a free end adapted to be welded to the bucket of a tractor, each of plates having an aperture therethrough with a pin positioned through the aperture of the plates and the apertures at the upper end of the upper pipe with the pipe located between the plates for applying a driving force from the bucket through the plates, pin and driving assembly; a pair of safety handles secured with respect to the lower end of the lower pipe, the safety handles having vertically extending elongated extents with an axis parallel to, but offset from, the axis of the pipe and with short inwardly turned extents welded to the lower tube beneath the longitudinal midpoint thereof; a pair of collar bolts positioned with their head ends interior of the lower pipes and extending radially outward through the lower apertures in the lower pipe with each bolt having an associated nut threadably coupled thereto and spaced from the exterior surface of the lower tube; and a collar having a cylindrical upper extent with downwardly extending recesses formed therein adapted to receive the ends of the collar bolts exterior of the tube but interiorly of the nuts with a circular plate at its lower extent having an enlarged diameter to function as a stop when used in driving posts, the collar and plate having an axial aperture for receiving the upper end of a post to be driven by inserting its upper end through the plate and lower half of the collar to the point where contact is made between the upper end of the post and the lower end of the lower pipe.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved tractor steel post driver which have all the advantages of the prior art various devices for driving posts into the ground and none of the disadvantages.

It is another object of the present invention to provide a new and improved tractor steel post driver which may be easily and efficiently manufactured and marketed.

It is further object of the present invention to provide a new and improved tractor steel post driver which are of durable and reliable constructions.

An even further object of the present invention is to provide a new and improved tractor steel post driver which are susceptible of a low cost of manufacture with regard to both materials and labor, and which accordingly are then susceptible of low prices of sale to the consuming public, thereby making such tractor steel post driver economically available to the buying public.

Still yet another object of the present invention is to provide a new and improved tractor steel post driver which provide in the apparatuses and methods of the prior art some of the advantages thereof, while simultaneously overcoming some of the disadvantages normally associated therewith.

Still another object of the present invention is to drive or set steel posts into the ground in a faster more convenient manner.

Lastly, it is an object of the present invention to provide new and improved tractor steel post driver comprising an elongated driving assembly having an upper cylindrical pipe with an upper end and a lower end, and a lower pipe with an upper end and a lower end, the upper pipe and lower pipe being coupled to have a common central axis, the upper end of the lower pipe being enlarged with the lower end of the upper pipe fitted within the enlargement, the upper end of the upper pipe being provided with a radial aperture extending therethrough, the lower end of the lower pipe being provided with a lower radial aperture extending therethrough; a bracket formed of two small parallel plates, each of the plates having a free end, each of plates having an aperture therethrough with a pin positioned through the aperture of the plates and the apertures at the upper end of the upper pipe with the pipe located between the plates; a pair of collar bolts positioned with their head ends interior of the lower pipes and extending radially outward through the lower apertures in the lower pipe; and a collar having a cylindrical upper extent with downwardly extending recesses formed therein adapted to receive the ends of the collar bolts exterior of the tube but interiorly of the nuts with a circular plate at its lower extent having an enlarged diameter to function as a stop when used in driving posts, the collar and plate having an axial aperture for receiving the upper end of a post to be driven by inserting its upper end through the plate and lower half of the collar to the point where contact is made between the upper end of the post and the lower end of the lower pipe.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
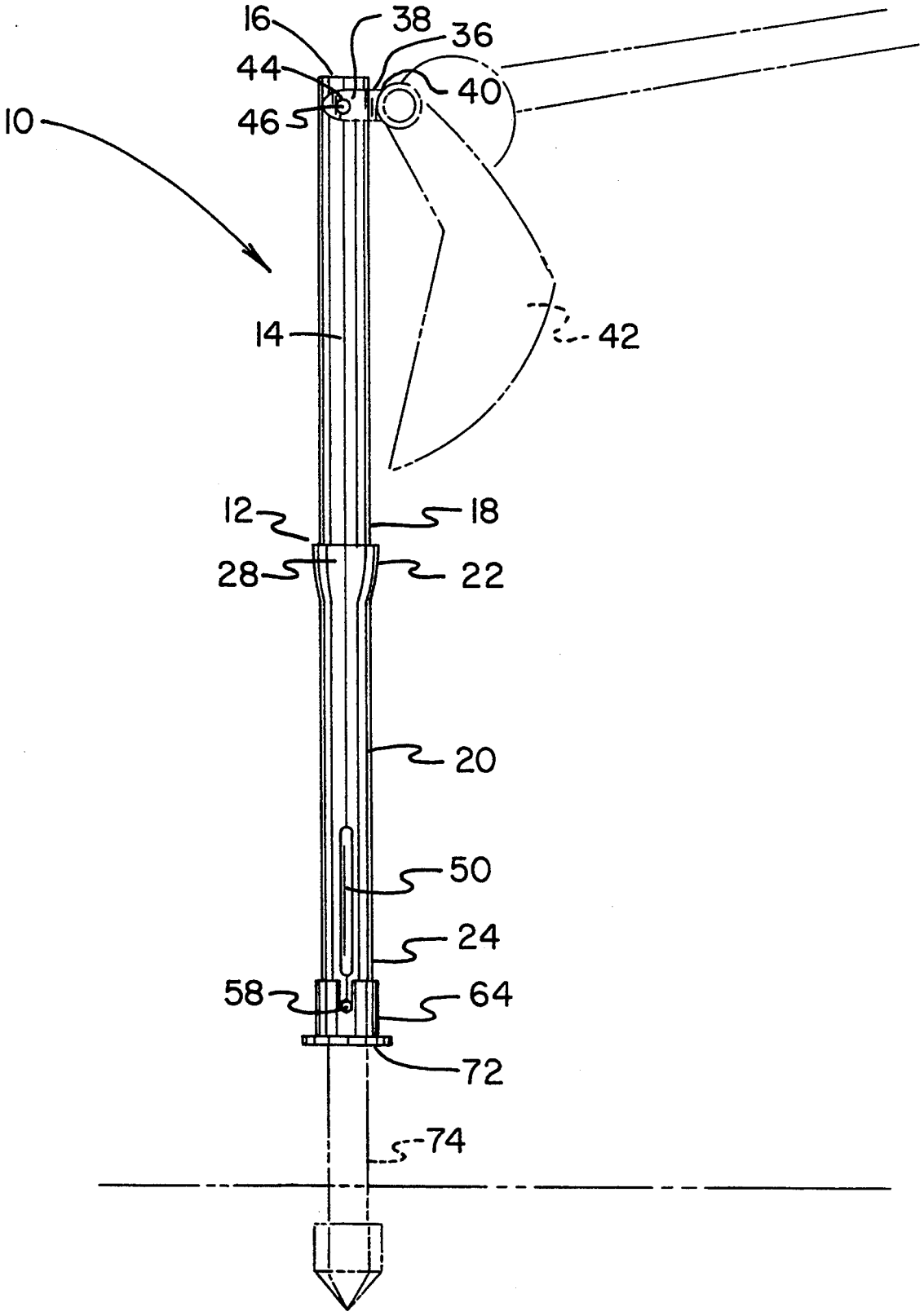
FIG. 1 is a side elevational view of the preferred embodiment of the tractor steel post driver constructed in accordance with the principles of the present invention.
Figure 2:
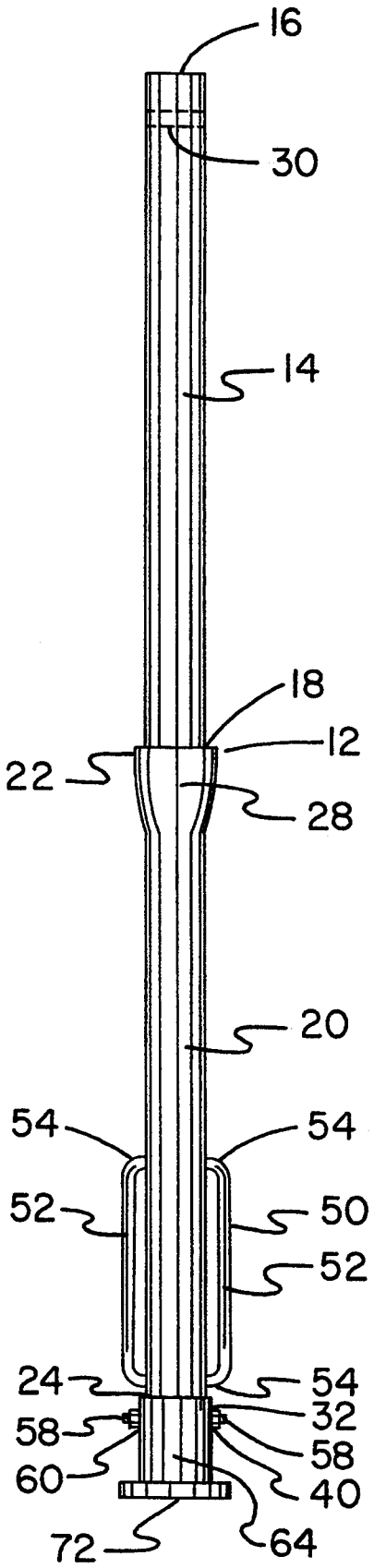
FIG. 2 is a side elevational view illustrating the device shown in FIG. 1.
Figure 3:
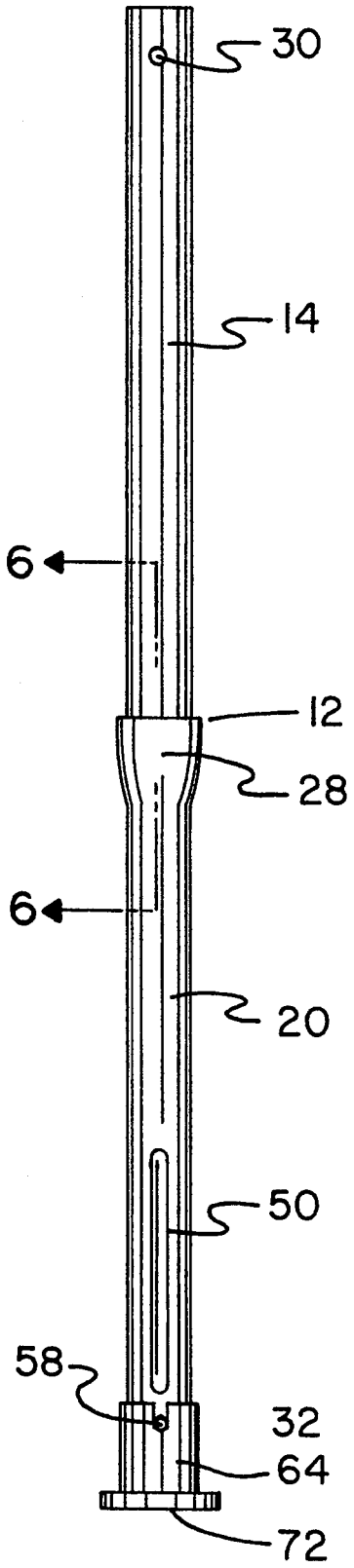
FIG. 3 is front elevational view of the device illustrated in FIGS. 1 and 2.
Figure 4:
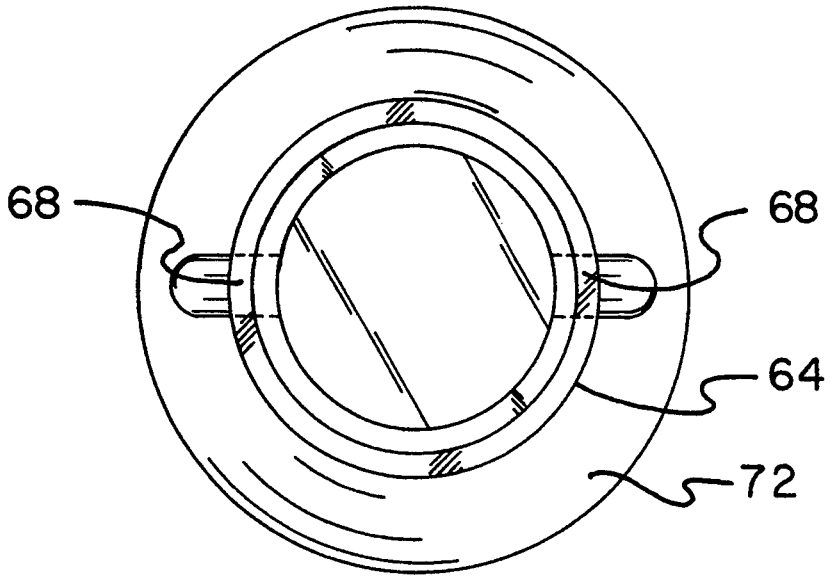
FIG. 4 is a top elevational view of the collar portion of the device shown in the prior Figures.
Figure 5:
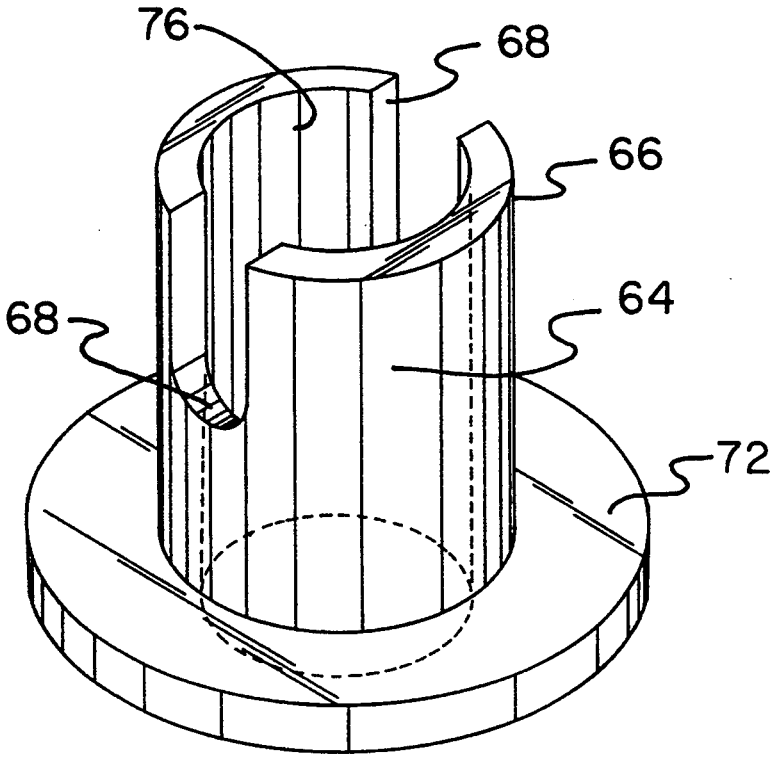
FIG. 5 is a perspective illustration of the collar shown in FIG. 4.
Figure 6:
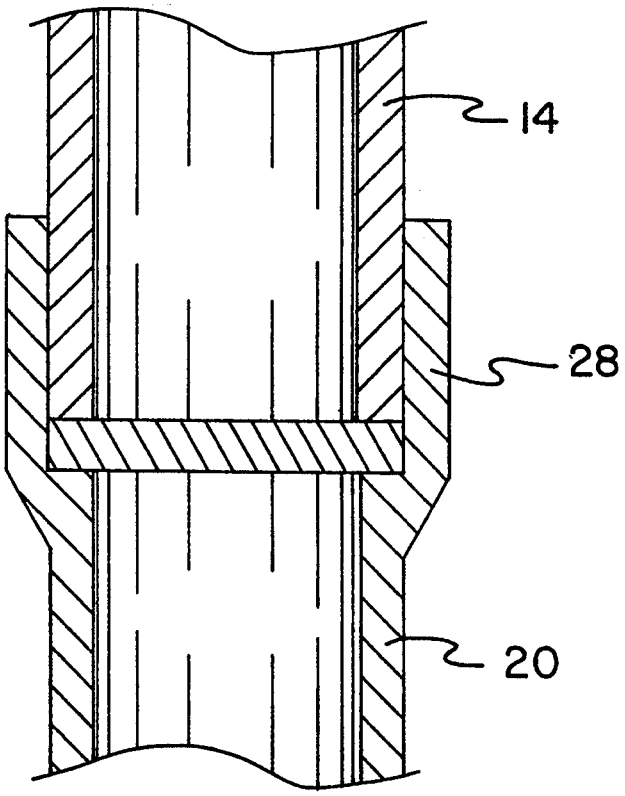
FIG. 6 is a cross sectional view taken along line 6—6 of FIG. 3.
Figure 7:
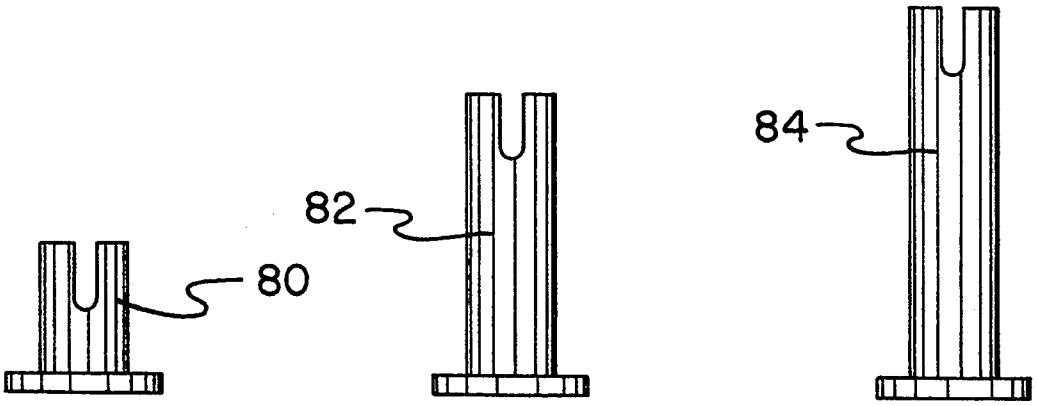
FIG. 7 is side elevational views of the collars employed with the device of FIGS. 1 through 3.

With reference now to the drawings, and in particular to FIG. 1 thereof, the preferred embodiment of the new and improved tractor steel post driver embodying the principles and concepts of the present invention and generally designated by the reference numeral 10 will be described.

The present invention, the new and improved tractor steel post driver is comprised of a plurality of component elements. Such component elements in their broadest context, include a driver assembly, a bracket, safety handles, collar bolts and a collar. Such components are individually configured and correlated with respect to each other so as to attain the desired objectives.

The central component of the system 10 of the present invention is an elongated driving assembly 12. The driving assembly has an upper cylindrical pipe 14. Such pipe has an upper end 16 and a lower end 18. In addition, the driving assembly includes a lower pipe 20. Such lower pipe has an upper end 22 and a lower end 24. In operation and use, the upper pipe and the lower pipe are coupled together to have a common central axis.

The upper end of the lower pipe is formed with an enlargement 28. Such enlargement is adapted to be fitted with and receive the lower end of the upper pipe. In addition, the upper end of the upper pipe is provided with a radial aperture 30. Such aperture extends through the both walls of the pipe. In addition, the lower end of the lower pipe is provided with a lower radial aperture 32 extending through both of the walls of the lower end of the lower pipe.

Next provided is part of the system is a bracket 36. The bracket is formed of two small parallel plates 38. Each of the plates has a free end 40 adapted to be welded to the bucket 42 of a tractor. Each of the plates has an aperture 44 extending therethrough. In addition, a pin 46 is positioned through the aperture of the plates and the apertures at the upper end of the upper pipe. In such position, the pipe is located between the plates to allow for pivoting motion therebetween. Such an arrangement is for applying a driving force from the tractor, its bucket, the plates, pin and driving assembly.

Next provided is a pair of safety handles 50. Such handles are secured with respect to the lower end of the lower pipe. The safety handles each have a vertically extending elongated extent 52. The axis of each of these extents is parallel to, but offset from, the axis of the pipes. In addition, the safety handles include short inwardly turned extents 54. Such in turned extents are welded to the lower tube beneath the longitudinal midpoint thereof.

The system also includes a pair of collar bolts 58. The collar bolts are positioned with their head ends interior of the lower pipes. The remainder of such bolts extend radially outwardly through the lower apertures of the lower pipe. The two bolts have a common axis. Each bolt has an associated nut 60. Such nuts are threadedly coupled to, and spaced from, the exterior surface of the lower tube.

The last component of the system is a collar 64. The collar has a cylindrical upper extent 66. Such upper extent has downwardly extending recesses 68. The recesses are formed therein at diametrically opposed positions. They are adapted to receive the ends of the collar bolts exterior of the tube but interiorly of the nuts. In addition, the collar includes a circular plate 72. Such circular plate is at the lower extent of the collar. The circular plate has an enlarged diameter to function as a stop when used for driving posts 74. The collar and its plate has an axial aperture 76 extending therethrough with its axis coextensive with the axis of the pipes. Such aperture is for receiving the upper end of the post to be driven by inserting the post's upper end through the aperture of the plate and the lower half of the collar. The post extend upwardly to the point where contact is made between the upper end of the post and the lower end of the lower pipe.

The last component of the system is a plurality of collars 80, 82 and 84. The collars are of varying lengths for varying the extent of longer posts to be driven through the system 10.

The present invention is designed to drive steel fence posts into the ground using the bucket of a tractor to provide the driving force. It is comprised of two steel pipes and associated hardware. The pipes are welded together in a coaxial arrangement with the upper pipe having a partial axial engagement with the lower. This forms the post driver.

To engage the driver with the bucket, two brackets are welded along the upper edge of the bucket. Each of these sheet steel brackets has a through hole which is aligned as the brackets are welded in place to form a yoke-like receptacle. The upper pipe of the driver also has a through transverse hole. A cross pin is used to mount the driver in place so it is closely straddled by the brackets and free to swivel. Side mounted, closed loop safety handles are affixed to either side of the lower pipe of the driver, and a variety of different length collars are used as spacers to obtain the exact desired height of the fence post.

With the fence post inserted within the lower section of the driver, the bucket may be used to safely and efficiently drive it home. Since the driver is free to swivel, perfect vertical orientation of the post is assured. The spacing collars assure a consistent height across each of the posts.

The present invention will drive a post in less than half of the time required when using a conventional hand driver, and manual force is not required. When the bucket is needed for other uses, the driver can be quickly removed. The two small brackets will not interfere with the function of the bucket.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved tractor steel post driver comprising, in combination:

an elongated driving assembly having an upper cylindrical pipe with an upper end and a lower end, and a lower pipe with an upper end and a lower end, the upper pipe and lower pipe being coupled to have a common central axis, the upper end of the lower pipe being enlarged with the lower end of the upper pipe fitted within the enlargement, the upper end of the upper pipe being provided with a radial aperture extending therethrough, the lower end of the lower pipe being provided with a lower radial aperture extending therethrough;

a bracket formed of two small parallel plates, each of the plates having a free end adapted to be welded to the bucket of a tractor, each of plates having an aperture therethrough with a pin positioned through the aperture of the plates and the apertures at the upper end of the upper pipe with the pipe located between the plates for applying a driving force from the bucket through the plates, pin and driving assembly;

a pair of safety handles secured with respect to the lower end of the lower pipe, the safety handles having vertically extending elongated extents with an axis parallel to, but offset from, the axis of the pipe and with short inwardly turned extents welded to the lower tube beneath the longitudinal midpoint thereof;

a pair of collar bolts positioned with their head ends interior of the lower pipes and extending radially outward through the lower apertures in the lower pipe with each bolt having an associated nut threadably coupled thereto and spaced from the exterior surface of the lower tube; and a collar having a cylindrical upper extent with downwardly extending recesses formed therein adapted to receive the ends of the collar bolts exterior of the tube but interiorly of the nuts with a circular plate at its lower extent having an enlarged diameter to function as a stop when used in driving posts, the collar and plate having an axial aperture for receiving the upper end of a post to be driven by inserting its upper end through the plate and lower half of the collar to the point where contact is made between the upper end of the post and the lower end of the lower pipe.

2. A tractor steel post driver comprising:

an elongated driving assembly having an upper cylindrical pipe with an upper end and a lower end, and a lower pipe with an upper end and a lower end, the upper pipe and lower pipe being coupled to have a common central axis, the upper end of the lower pipe being enlarged with the lower end of the upper pipe fitted within the enlargement, the upper end of the upper pipe being provided with a radial aperture extending therethrough, the lower end of the lower pipe being provided with a lower radial aperture extending therethrough;

a bracket formed of two small parallel plates, each of the plates having a free end, each of plates having an aperture therethrough with a pin positioned through the aperture of the plates and the apertures at the upper end of the upper pipe with the pipe located between the plates;

a pair of collar bolts positioned with their head ends interior of the lower pipes and extending radially outward through the lower apertures in the lower pipe; and a collar having a cylindrical upper extent with downwardly extending recesses formed therein adapted to receive the ends of the collar bolts exterior of the tube but interiorly of the nuts with a circular plate at its lower extent having an enlarged diameter to function as a stop when used in driving posts, the collar and plate having an axial aperture for receiving the upper end of a post to be driven by inserting its upper end through the plate and lower half of the collar to the point where contact is made between the upper end of the post and the lower end of the lower pipe.

3. The apparatus as set forth in claim 2 and further including:

a pair of safety handles secured with respect to the lower end of the lower pipe, the safety handles having vertically extending elongated extents with an axis parallel to, but offset from, the axis of the pipe and with short inwardly turned extents welded to the lower tube beneath the longitudinal midpoint thereof.

4. The apparatus as set forth in claim 2 and further including a plurality of collars of varying lengths for handling posts of varying lengths.

* * * * *